United States Patent [19]

Enomoto et al.

[11] 4,294,045

[45] Oct. 13, 1981

[54] GRINDING MACHINE WITH A SIZING DEVICE

[75] Inventors: Minoru Enomoto, Ohbu; Takao Yoneda, Toyoake; Yoshiyuki Takeuchi, Gamagouri, all of Japan

[73] Assignee: Toyoda Koki Kabushiki Kaisha, Kariya, Japan

[21] Appl. No.: 114,646

[22] Filed: Jan. 23, 1980

[30] Foreign Application Priority Data

Jan. 30, 1979 [JP] Japan ..... 54-9502

[51] Int. Cl.[3] ..... B24B 49/02

[52] U.S. Cl. ..... 51/165.71; 51/165.77; 51/165.91

[58] Field of Search ..... 51/105 SP, 165.77, 165.91, 51/289 R, 165.71

[56] References Cited

U.S. PATENT DOCUMENTS

| | | | |
|---|---|---|---|
| 3,663,189 | 5/1972 | Koide | 51/165.77 |
| 4,115,958 | 9/1978 | Englander | 51/289 R |
| 4,177,607 | 12/1979 | Toda | 51/165.91 |
| 4,179,854 | 12/1979 | Munekata et al. | 51/165.77 |

FOREIGN PATENT DOCUMENTS

| | | |
|---|---|---|
| 1577485 | 9/1974 | Fed. Rep. of Germany . |
| 48-39317 | of 1973 | Japan . |

*Primary Examiner*—Harold D. Whitehead

*Attorney, Agent, or Firm*—Oblon, Fisher, Spivak, McClelland & Maier

[57] ABSTRACT

A grinding machine wherein a wheel support carrying a grinding wheel is moved along a straight path extending at an acute angle to an axis of rotation of a workpiece. For the subsequent simultaneous grindings of a cylindrical surface and a shoulder side surface perpendicular thereto of the workpiece, the position of a transverse table carrying the workpiece is adjusted in proportion to a designated finish diameter of the cylindrical surface. The position of a sizing device slidable in the axial direction of the workpiece is also adjusted in connection to the positional adjustment of the transverse table, so that a pair of feelers of the sizing device are engaged with the cylindrical surface at a position which is spaced by a designated distance from the shoulder side surface.

6 Claims, 6 Drawing Figures

GRINDING MACHINE WITH A SIZING DEVICE

BACKGROUND OF THE INVENTION

1. Field of the Invention

The present invention relates in general to an angular slide type cylindrical grinding machine and more particularly, to a novel positioning control of a sizing device used in such a grinding machine.

2. Description of the Prior Art

Generally, an angular slide type cylindrical grinding machine is used for simultaneously grinding a cylindrical surface and a shoulder side surface, which extends perpendicularly thereto, of a workpiece. A grinding wheel in such a grinding machine is formed at a circumferential surface thereof with a first surface of grinding the cylindrical surface and a second surface perpendicular to the first surface of grinding the shoulder side surface and is moved along a straight path extending at an acute angle $\theta$ to the axis of rotation of the workpiece. The infeed movement of the grinding wheel along the straight path causes the second surface of the wheel for shoulder side grinding to be displaced in an axial direction of the workpiece, and therefore, the axisl position of the workpiece must be adjusted in advance of the grinding of the workpiece. This axial position adjustment is, for example, such that when the cylindrical surface 17 of the workpiece W is finished to a diameter Di, as shown in FIG. 1, the shoulder side surface 16 finished simultaneously therewith is spaced by a distance $\Delta l$ (i.e., $Di/2 \cdot \text{cotan}\ \theta$) from an intersection P at which the rotational axis 14 of the workpiece W intersects a line 13 that extends through the juncture G of the wheel first surface 11 with the wheel second surface 12 in parallel relation with the straight path The method and apparatus for practicing such position adjustment of the workpiece is known by West German Patent Application N. 1,577,485.

Where sizing is used in such a grinding machine, the engaging points of the sizing device with the cylindrical surface 17 must be adjusted in connection with the adjustment of the workpiece axial position. The purpose of such adjustment of the engaging point S may be to prevent interference between the workpiece shoulder side surface 16 and a pair of feelers of the sizing device, to make the fellers engage the workpiece cylindrical surface 17 at a position apart from a keyway formed on the cylindrical surface, or to make the feelers engage a portion of the cylindrical surface 17 which does not contact a portion of the grinding wheel 10 where local wear occurs. However, since the sizing device is mounted on a bed of the grinding machine and the workpiece is supported on a work table slidable on the bed, movement of the workpiece in its axial direction results in changing the relative position of the sizing device to the workpiece shoulder side surface.

SUMMARY OF THE INVENTION

It is, therefore, a primary object of the present invention to provide an improved angular slide type grinding machine capable of automatically positioning a feeler of a sizing device at a position which is spaced by a desired distance from a shoulder side surface of the workpiece in an axial direction of the workpiece even when the workpiece cylindrical surfaces to be ground vary from one another in diameter.

Another object of the present invention is to provide an improved angular slide type grinding machine of the character set forth above, wherein only by designating a distance between a shouder side surface of a workpiece and a desired engaging point at which a feeler of a sizing device engages a cylindrical surface of the workpiece, it is possible to automatically position the feeler at the desired engaging point.

Briefly, according to the present invention, there is provided a grinding machine, which comprises a bed, a work support slidable on the bed and adapted to carry a workpiece, having a cylindrical surface and a shoulder side surface perpendicular thereto, for rotation about an axis extending in the sliding direction of the work support, a wheel support rotatably carrying a grinding wheel and slidable on the bed along a straight path extending at an acute angle to the rotational axis of the workpiece for simultaneously grinding with the wheel the cylindrical and shoulder side surfaces of the workpiece, and first and second feed devices for respectively moving the work support and the wheel support on the bed.

The grinding machine also includes a sizing device having a feeler engageable with the cylindrical surface of the workpiece, a guide member for slidably guiding the sizing device in the axial direction of the workpiece, a third feed device connected to the sizing device for moving the same on the guide member, and a positioning controller connected to the third feed device for controlling the same. This controller comprises a calculation circuit responsive to first input data indicative of a desired finish diameter of the cylindrical surface for calculating a cotangent component at the acute angle of the desired finish diameter and control means responsive to the cotangent component supplied from the calculation circuit, and second input data for controlling the third feed device to locate the feeler at a position which is spaced from the shoulder side surface a distance designated by the second input data.

BRIEF DESCRIPTION OF THE DRAWINGS

Varius other objects, features and attendant advantages of the present invention will readily be appreciated as the same becomes better understood by reference to the following detailed description of preferred embodiments when considered in connection with the accompanying drawings, in whiuch.

DETAILED DESCRIPTION OF THE PREFERRED EMBODIMENTS

Figure 1:
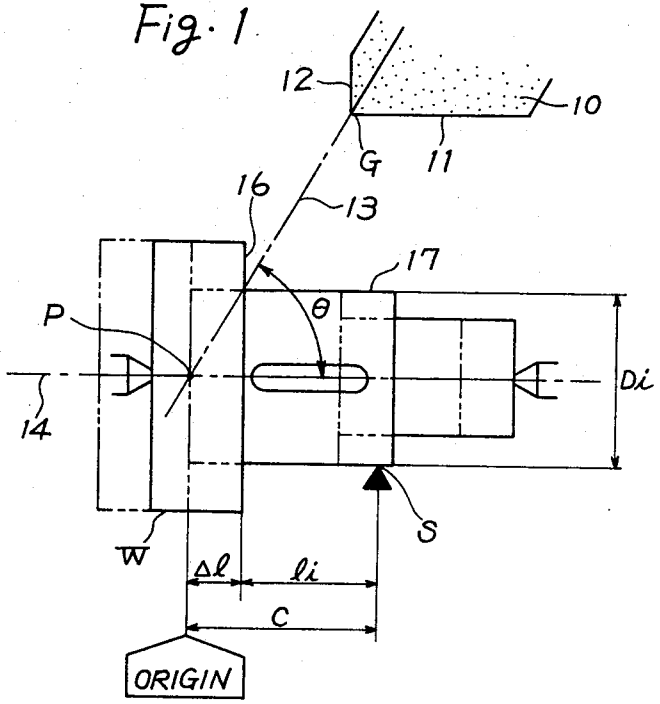
FIG. 1 is a diagrammatical explanatory view illustrative of the principle of the present invention.
Figure 2:
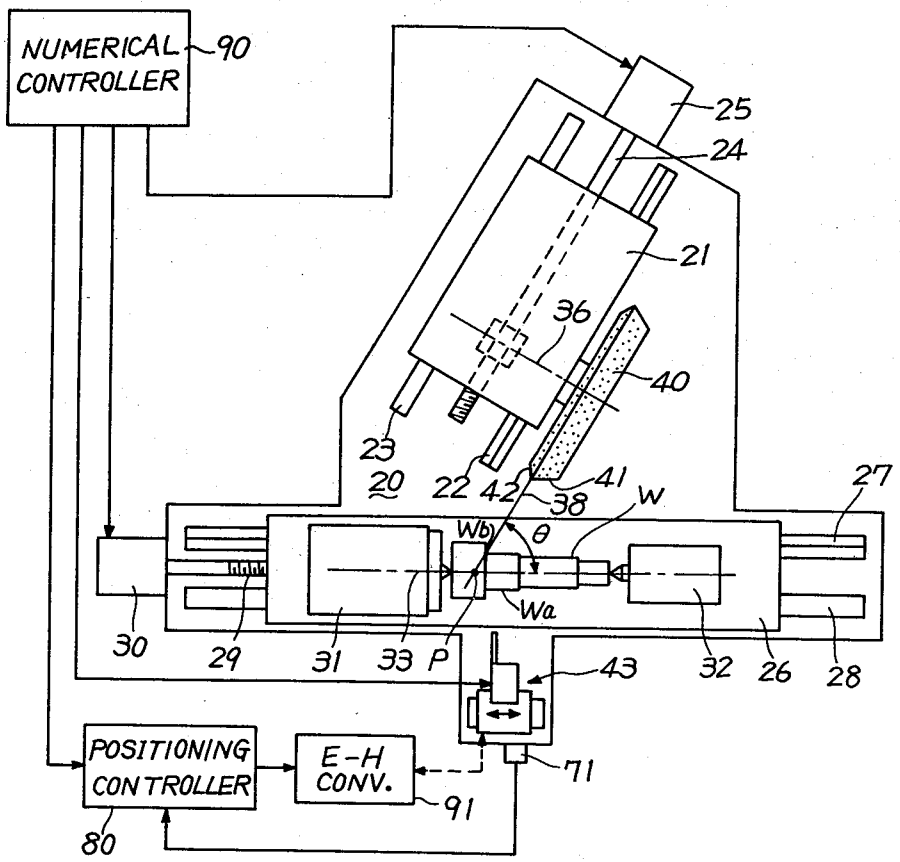
FIG. 2 is a plan view of an angular slide type grinding machine according to the present invention.

Referring now to the drawings, wherein like reference numerals designate the same or corresponding parts throughout the several views, and particularly to FIG. 2 thereof, there is illustrated a wheel head 21, which is slidably guided on a pair of guide ways 22 and 23 formed on a bed 20 and with which is threadedly engaged a feed screw 24 rotatable by a servomotor 25. Also formed on the bed 20 are another pair of guide ways 27 and 28, on which is slidably guided a transverse table 26, which is threadedly engaged with another feed screw 29 rotatable by another servomotor 30. The transverse table 26 has mounted thereon a workhead 31 and a footstock 32, which cooperate with each other to rotatably carry a workpiece W. The rotational axis 33 of the workpiece W extends in parallel relation with the guide ways 27, 28 for the transverse table 26 and at an acute angle $\theta$ to a straight path 38, along which a grinding wheel 40 is moved. The workpiece W has a cylindrical surface Wa and a shoulder side surface Wb, which radially extends from one end of the cylindrical surface Wa. The grinding wheel 40, carried by the wheel head 21 for rotation about an axis 36 perpendicular to the above-noted straight path 38, is formed with a first surface 41 for grinding the cylindrical surface Wa of the workpiece W and a second surface 42 perpendicular to the first surface 41 for grinding the shoulder side surface Wb. In order to measure the diameter of the cylindrical surface Wa during grinding by the first surface 41 of the grinding wheel 40, there is further provided a sizing device 43, which is guided on the bed 20 for sliding movement in a direction parallel to the rotational axis 33 of the workpiece W.

Figure 3:
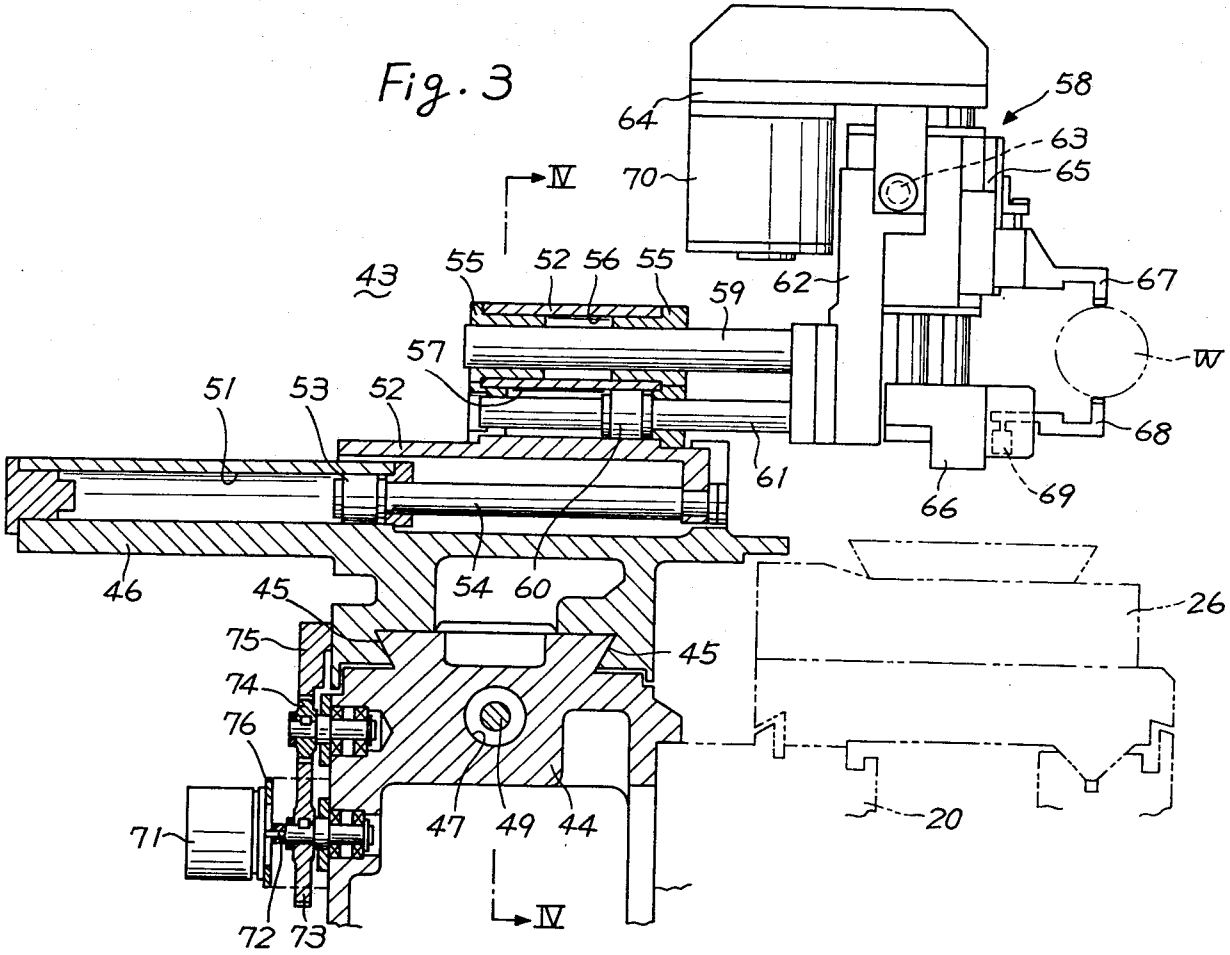
FIG. 3 is a longitudinal sectional view of a sizing device positioning mechanism incorporated into the grinding machine.
Figure 4:
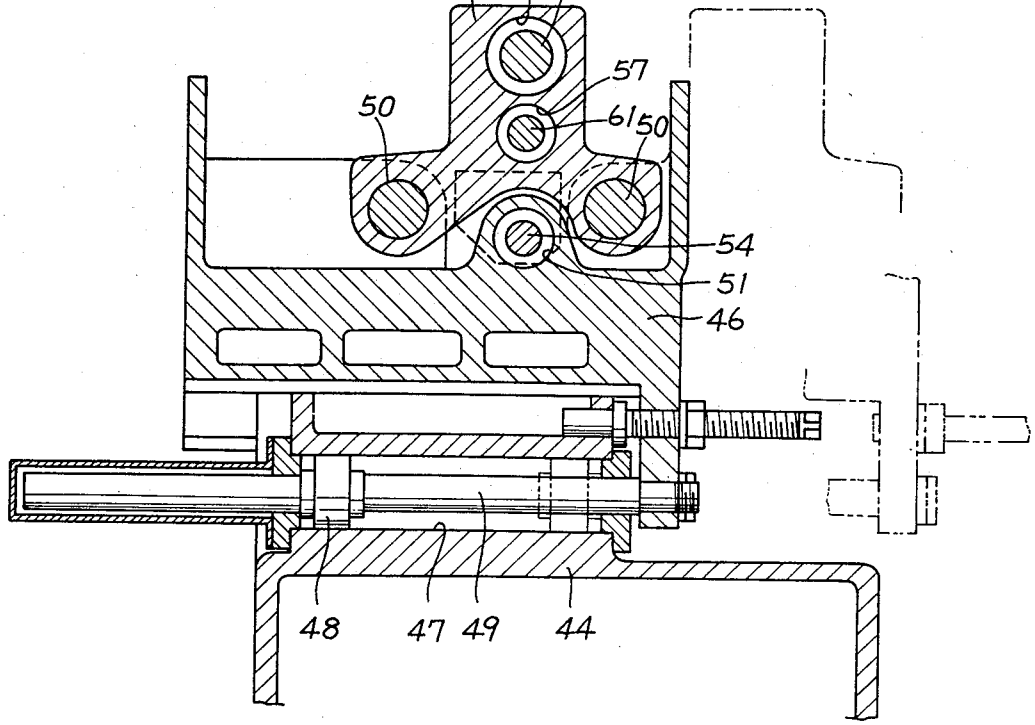
FIG. 4 is a transverse sectional view of the sizing device positioning mechanism taken along the line IV—IV of FIG. 3.

The construction of the sizing device 43 will be described in detail hereinafter with reference to FIGS. 3 and 4. Fixed on the bed 20 is guide base 44, on which a guide way 45 is formed in parallel relation with the rotational axis of the workpiece W, and a slide member 46 is guided along the guide way 45. The guide base 44 is formed therein with a transverse feed cylinder 47 containing a piston 48, whose piston rod 49 is connected to the slide member 46. The slide member 46 carries thereon a pair of pilot bars 50, 50 extending at a right angle to the rotational axis 33 of the workpiece W and is formed with a first approach cylinder 51 extending in parallel relation with the pilot bars 50, 50. The pilot bars 50, 50 have slidably carried therealong a support block 52, which is connected to a piston rod 54 of piston 53 contained in the first approach cylinder 51. The support block 52 is formed with a bore 56 receiving guide sleeves 55, 55 and a second approach cylinder 57 containing a piston 60. A pilot bar 59 connected to sizing head 58 is slidably inserted into the guide sleeves 55, and a piston rod 61 of the piston 60 is connected to the sizing head 58. Accordingly, the sizing head 58 is moved from a retracted position to an intermediate position when only the piston 53 is advanced and to an advanced position for measurement when the piston 60 is advanced in addition to the piston 53.

The sizing head 58 includes a head support 62 connected to both of the pilot bar 59 and the piston rod 61 and a cradle member 64 carried by the head support 62 for pivotal movement about a hinge pin 63 extending in parallel relation with the rotational axis 33 of the workpiece W. A pair of upper and lower feeler supports 65, 66 are so mounted by the cradle member 64 that they are simultaneously and equally movable towards and away from each other. A pair of upper and lower feelers 67, 68 protrude respectively from the upper and lower supports 65 and 66, a detector 69 is provided in the lower feeler support 66 for detecting the displacement of the lower feeler 68 relative to the lower feeler support 66. In the measuring head 58, there are further incorporated a feed mechanism (not shown) and servomotor 70 drivingly connected thereto, which cooperate with each other for effecting the mutual approach and separate movement of the feelers 67, 68. Accordingly, when feed pulses are applied to the servomotor 70, the distance between the upper and lower feelers 67, 68 is adjusted as desired, so that it is possible to obtain from the detector 69 a sizing signal which represents a workpiece diameter corresponding to the adjusted feeler distance. The measuring head 58 is more fully described in U.S. Pat. No. 3,745,660 to Hiroaki Asano et al., and thereofore, further description with respect thereto is omitted for the sake of brevity.

The guide base 44 also has mounted on a front surface thereof a bracket 76, on which is fixedly provided an encoder 71 having an input shaft 72 rotatable bodily with a gear 73. This gear 73 is in meshing engagement with a rack 75 secured to the slide member 46 through an idle gear 74 rotatably carried on the guide base 44. Therefore, when the slide member 46, that is, the sizing head 58, is moved along the rotational axis 33 of the workpiece W, such movement can be precisely detected by the encoder 71.

The encoder 71 is of an absoulte type, and adjustment is made to ensure that the encoder 71 outputs a signal indicative of an absolute zero position when the feelers 67, 68 of the sizing head 58 are brought into alignment with an intersection P where the straight line path 38 passing thruogh an abutment or juncture of the wheel first surface 41 with the wheel second surface 42 intersects the rotational axis 33 of the workpiece W. Thus, the distance between an engaging point of the feelers 67, 68 with the workpiece W and the intersection P is detected by the encoder 71 and is output therefrom in the form of an absolute value counted from the intersection P.

Figure 5:
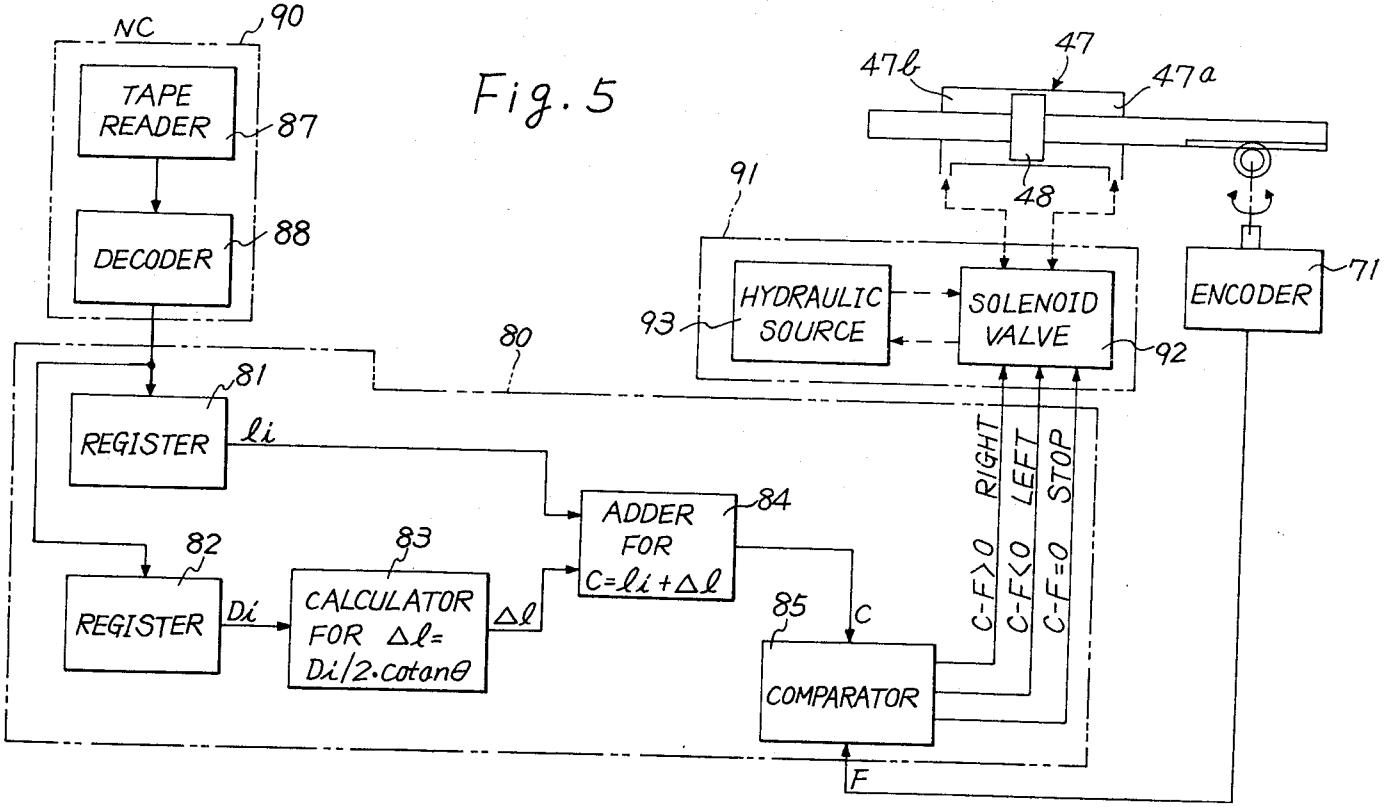
FIG. 5 is a block diagram of a positioning controller for controlling the positioning mechanism.

The output signal from the encoder 71 is supplied to a positioning controller 80, the detail of which is shown in FIG. 5. As seen therein, the positioning controller 80 includes a first register 81, to which first input data Li that designates a distance between a desired engaging point of the feelers 67, 68 and the shoulder side surface Wb of the workpiece W is input through a tape reader 87 and a decoder 88 of a conventional numerical controller 90. A second register 82 is also provided connected to the decoder 88 so as to receive second input data Di designating a finish diameter of the workpiece cylindrical surface Wa. A calculation circuit 83, connected to the second register 82, is responsive to the second input data Di to thereby obtain a compensation value $\Delta l$ by performing a calculation of $\Delta l = Di/2 \cdot \cot an\ \theta$. The first input data li and the compensation value $\Delta l$ are input to an addition circuit 84 for addition therein, and the added value C is input to a comparator 85 for comparison with the output signal F from the encoder 71. This comparator 85 outputs a rightward instruction signal when the added value C is larger than the encoder output signal F, outputs a leftward instruction signal when the value C is smaller than the signal F and outputs stop instruction signal when the value C coincides with the signal F. The rightward, leftward and stop instruction signals are selectively applied to an electric-hydraulic converter 91 including a magnetic changeover value 92, which is in fluid connection to the transverse feed cylinder 47. Accordingly, the changeover valve 92, upon receiving the rightward instruction signal, delivers pressurized fluid from a hydraulic source 93 to a left chamber 47*b* of the transverse feed cylinder 47 and, upon receiving the leftward instruction signal, delivers pressurized fluid to the right chamber 47*a* of the cylinder 47. Further, the changeover valve 92, upon receiving the stop instruction signal, discontinues the delivery of pressurized fluid to any of the chambers 47*a*, 47*b* of the cylinder 47, whereby the positional adjustment of the sizing head 58 in the axial direction of the workpiece W is completed. In advance of this positional adjustment of the sizing head 58, the slide position of the transverse table 26 is adjusted to locate the workpiece W at such a position that the shoulder side surface Wb is spaced from the intersection P by a distance corresponding to a cotangent component $\Delta l$ at the acute angle $\theta$ of a half of a diameter Di to which the cylindrical surface Wa is to be finished. This positional adjustment of the transverse table 26 is performed by the use of the apparatus (not shown) disclosed in the above-noted West German patent application. Thus, upon completion of such positional adjustment, the sizing device 58 is positioned with the feelers 67,68 which are spaced from the shoulder side surface Wb by a desired distance li stored in the first register 81.

The first register 81 keeps the previous first input data li stored therein until receiving new first input data. Accordingly, where the simultaneous grindings of another cylindrical surface and another shoulder side surface of the workpiece W are to be effected in succession to those of the cylindrical and shoulder side surfaces Wa and Wb, but where the relative distance of the feelers 67, 68 to the another shoulder side surface is to be kept the same as in the grinding of the surfaces Wa and Wb, it is unnecessary to designate the first input data li in numerical control (NC) data for the latter grinding. In this case, following the positional adjustment of the transverse table 26, the transverse position of the sizing head 58 is compensated for the difference in diameter between the cylindrical surface Wa and the other cylindrical surface, so that the sizing head 58 is positioned with the feelers 67, 68, which are spaced from the other shoulder side surface a distance designated by the first input data li as in the case of the previous grinding.

Although the above-described embodiment uses a hydraulic actuator 47 as transverse feed means for the sizing device 43, it is otherwise possible to use a servomotor responsive to command pulse signals instead of the actuator 47, in which case the positional adjustment of the sizing head 58 can be carried out by providing in place of the comparator 85 a pulse generating circuit which is capable of applying to the servomotor pulse signals of the number corresponding to the difference between the added value C and the encoder output F in response thereto.

Figure 6:
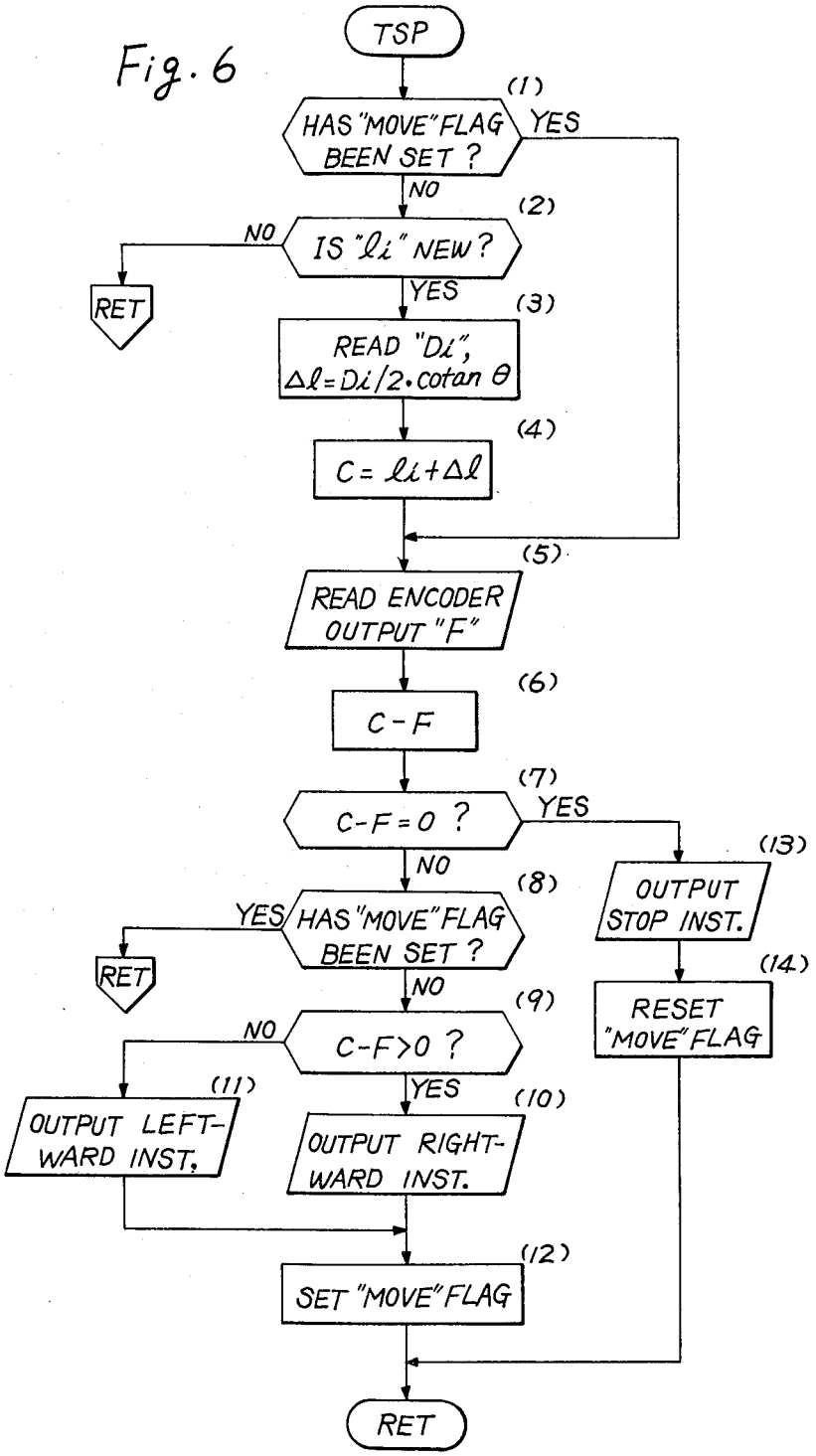
FIG. 6 is a flow chart of a positioning control program executed by a computerized numerical controller for performing the same function as the positioning controller in place thereof.

The functions that the components 81-85 of the positioning controller 80 perform are otherwise performed by the numerical controller 90 where the same is of the type generally known as a computerized numerical controller (hereinafter referred to as "CNC controller") which incorporates a general purpose digital computer. This is achieved by storing a positioning control program TSP shown in FIG. 6 in a memory device (not shown) of the CNC controller 90 and periodically executing the program TSP. In the memory device, there are also stored numerical control (NC) data and a grinding control program, which is executed for successively reading out a plurality of data blocks of the NC data and for controlling the wheel feed servomotor 25, the table feed servomotor 30 and the feeler space adjusting servomotor 70 in accordance with the read-out data blocks of the NC data. In the NC data, there are designated data indicative of a measuring point li of the feelers 67, 68 and data indicative of a number of workpiece finish diameters Di. Each of the data indicative of the workpiece diameters Di is used for adjusting the space between the feelers 67 and 68 and is also used together with the data indicative of the measuring point li for adjusting the engaging point of the feelers 67, 68 with a workpiece W. For this purpose, the memory device of the CNC controller 90 has assigned therein first and second register areas, which respectively store the data li and the data Di and to which reference is made in the course that the program TSP is executed.

The program TSP involves step 1 of ascertaining whether or not a MOVE flag MVFG (not shown) is in set state, thereby confirming that the sizing device 3 has been instructed to move in the axial direction of the workpiece W. If the flag MVFG is in set state, step 5 is reached, while if the flag MVFG is in reset state, step 2 is next reached, wherein it is ascertained whether new first input data li has been designated or not, that is, whether the new first input data li differs from previous first input data li or not. If a difference is recognized therebetween, then step 3 and those following step 3 are executed, while if no difference is recognized therebetween, the execution of the program TSP is discontinued. Step 3 involves reading out the second input data Di from the second register area and obtaining a compensation value $\Delta l$ by effecting a calculation of $\Delta l = Di/2 \cdot \text{cotan}\ \theta$. The compensation value $\Delta l$ is added in step 4 to the first input data li, thus obtaining an absolute instruction value C indicative of the distance between an engaging point S of the feelers 67, 68 with the workpiece W and the intersection P.

Step 5 is then reached to read an output signal F of the encoder 71 indicating the present position of the feelers 67, 68. The difference between the absolute instruction value C and the feeler present position F is then calculated in Step 6 and is ascertained in step 7 as to whether it indicates zero or not. If the difference is not zero, step 8 is executed to ascertain whether the MOVE flag MVFG is in set state or not, and if so confirmed, the processing routine of the CNC computer is returned to its base routine (not shown) since it is meant that either of the rightward and leftward instruction signals has already been applied to the change-over valve 92. On the other hand, if the MOVE flag MVFG is in reset state, step 9 is then reached to ascertain whether the instruction value C is larger that the feeler present position F. The confirmation of $C-F>O$ results in the execution of step 10 to apply the rightward instruction signal to the change-over valve 92, while the confirmation of $C-F<O$ results in the execution of step 11 to apply the leftward instruction signal to the change-over valve 92. The MOVE flag MVFG is set in step 12, whereafter the processing of the CNC computer is returned to the base routine.

As mentioned previously, the execution of the program TSP is periodically repeated. Accordingly, the execution of the program TSP during the application of either of the rightward and leftward instruction signals to the change-over valve 92 causes the processing of the CNC computer to advance from step 1 to step 5 and then reach step 7 through step 6. If in step 7 there is confirmed no coincidence of the instruction value C with the feeler present position F, the processing of the CNC computer is returned to the base routine after step 8. However, if the execution of step 7 results in the confirmation of the coincidence between the values C and F, step 13 is then reached to apply the stop instruction signal to the change-over valve 92, and after the resetting of the MOVE flag MVFG in step 14, the processing of the CNC computer is returned to the base routine.

In this manner, the measuring position of the sizing head 58, that is, the engaging point S of the feelers 67, 68 with the workpiece W is compensated by the compensating amount Δl corresponding to the finish diameter Di of the workpiece W, whereby the feelers 67, 68 are positioned at the position that is spaced by the sum C of the values li and Δl from the intersection P. It is therefore possible to make the feelers 67, 68 engage the workpiece W at the position which is spaced by the first input data li from the shoulder side surface Wb of the workpiece W even where the cylindrical surface Wa of the workpiece W has any diameter. Moreover, since it is unnecessary for an operator to designate as measuring position designation data any other data than the distance between a desired measuring position S and the shoulder side surface Wb of the workpiece W, the programming of the numerical control data becomes easy, and the possibility of involving an error in the programming can advantageously be diminished.

Furthermore, where the transverse position of the sizing device 43 is adjusted in a position to make the feelers 67, 68 engage a middle portion in an axial direction of the workpiece cylindrical surface, a further adjustment of the sizing device transverse position is not required prior to the grinding of another cylindrical surface even in the presence of a slight difference between the diameters of the cylindrical surfaces. This is true where the cylindrical surfaces to be ground in succession are almost the same in width and are not formed on their circumferential surfaces with any keyway, spline or the like. In this case, data indicative of a half of the width of the cylindrical surface to be first ground is designated as the above-noted first input data li in the NC data programmed for the cylindrical surface, while the first input data is refrained from taking part of the NC data programmed for the cylindrical surface to be subsequently ground. In this connection, when the program TSP is executed in advance of the grinding of the successive cylindrical surface, it is confirmed in step 2 that the first input data li being stored in the first register area is not new. Consequently, the CNC controller is caused to return its processing to the base routine without executing step 3 and those following step 3, whereby the positioning operation of the sizing device 43 is not performed with respect to the cylindrical surface to be subsequently ground. It will be apparent that in the embodiment using the CNC controller, the positioning control of the sizing device 43 is performed only in the case where CN data for a cylindrical surface includes the first input data li, since step 3 and those following step 3 of the program TSP are executed by the designation of the first input data li in the NC data.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A grinding machine for simultaneously grinding with a grinding wheel a cylindrical surface and a shoulder side surface perpendicular thereto of a workpiece, comprising:

a bed;

work support means slidable on said bed, for carrying said workpiece for rotation about an axis extending in the sliding direction of said work support means;

a wheel support carrying said grinding wheel and slidable on said bed for movement along a straight path extending at an acute angle to the rotational axis of said workpiece;

first and second feed means connected to said work support means and said wheel support for moving the same on said bed, respectively;

a sizing device having feeler means engageable with said cylindrical surface of said workpiece for measuring the diameter of said cylindrical surface;

guide means for slidably guiding said sizing device in a direction parallel to the rotational axis of said workpiece;

third feed means connected to said sizing device for moving the same along said guide means; and a positioning controller connected to said third feed means for controlling the same and including first calculation circuit means responsive to first input data indicative of a desired finish diameter of said cylindrical surface for calculating a cotangent component at said acute angle of said desired finish diameter, second calculation circuit means responsive to said first calculation circuit means and second input data indicative of a first distance spaced from said shoulder side surface for adding said cotangent component and said second input data to thereby obtain command data indicative of a second distance from an intersection at which the rotational axis of said workpiece intersects a line extending through the juncture between first and second surfaces of said grinding wheel in parallel relation with said straight path, said first and second surfaces of said grinding wheel corresponding, respectively, to said cylindrical and shoulder side surfaces of said workpiece, and control means responsive to said second calculation circuit means for controlling said third feed means to position said feeler means at a position which is spaced said second distance from said intersection.

2. A grinding machine as set forth in claim 1, further comprising:

an encoder responsive to the sliding movement of said sizing device for outputting to said control means feedback data indicative of an absolute present position of said feeler means relative to said intersection.

3. A grinding machine as set forth in claim 2, wherein said control means comprise:

comparator circuit means connected to said second calculation circuit means and said encoder for comparing said command data with said feed back data and also connected to said third feed means for controlling the same to discontinue the sliding movement of said sizing device upon the coincidence between said command and feedback data.

4. A grinding machine as set forth in claim 3, wherein said third feed means comprises:

a hydraulic actuator connected to said sizing device for moving the same along said guide means; and a change-over valve connected to said hydraulic actuator and responsive to an output signal from said comparator for controlling the operation of said hydraulic actuator.

5. A grinding machine as set forth in claim 3 or 4, further comprising:

first data storage means for storing said first input data, being connected to said first calculation circuit means for applying thereto said first input data; and second data storage means for storing said second input data, being connected to said second calculation circuit means for applying thereto said second input data.

6. A grinding machine as set forth in claim 5, further comprising:

a numerical controller connected to said first and second feed means for controlling the same in accordance with numerical control information and also connected to said first and second data storage means for applying said first and second input data respectively thereto.

* * * * *